US012710258B2

(12) United States Patent
Denuelle et al.

(10) Patent No.: US 12,710,258 B2
(45) Date of Patent: Aug. 18, 2026

(54) ELECTRONIC DETONATOR SPOOL AND DETONATOR COMPRISING SUCH A SPOOL

(71) Applicant: DAVEY BICKFORD, Hery (FR)

(72) Inventors: Aymeric Denuelle, La Chapelle de Guinchay (FR); Félix Prieur, Vregille (FR)

(73) Assignee: DAVEY BICKFORD, Hery (FR)

( * ) Notice: Subject to any disclaimer, the term of this patent is extended or adjusted under 35 U.S.C. 154(b) by 182 days.

(21) Appl. No.: 18/688,158

(22) PCT Filed: Aug. 31, 2022

(86) PCT No.: PCT/FR2022/051637
§ 371 (c)(1),
(2) Date: Feb. 29, 2024

(87) PCT Pub. No.: WO2023/031555
PCT Pub. Date: Mar. 9, 2023

(65) Prior Publication Data

US 2024/0393093 A1 Nov. 28, 2024

(30) Foreign Application Priority Data

Sep. 1, 2021 (FR) ..... 2109153

(51) Int. Cl.
*F42D 1/045* (2006.01)

(52) U.S. Cl.
CPC ..... *F42D 1/045* (2013.01)

(58) Field of Classification Search
CPC ... F42D 1/045; F42D 1/00; F42D 1/04; B65H 75/14; B65H 75/185; B65H 2701/39; F42C 19/12
USPC ..... 361/248
See application file for complete search history.

(56) References Cited

U.S. PATENT DOCUMENTS

2010/0252672 A1* 10/2010 Hocker ..... B65H 75/30 242/611
2019/0101369 A1* 4/2019 Crichton ..... B65H 75/28
2019/0119066 A1* 4/2019 Muller ..... F42D 1/043

FOREIGN PATENT DOCUMENTS

EP 3531522 A1 * 8/2019 ..... B65H 75/28
GB 2260752 A * 4/1993 ..... B65H 49/26
WO 2017181207 A1 10/2017
WO 2020130492 A1 6/2020
WO 2020130495 A1 6/2020

OTHER PUBLICATIONS

International Search Report for PCT/FR2022/051637, mailed Nov. 10, 2022, 5 pages.
Written Opinion of the ISA for PCT/FR2022/051637, mailed Nov. 10, 2022, 5 pages.

* cited by examiner

*Primary Examiner* — Sreeya Sreevatsa
(74) *Attorney, Agent, or Firm* — NIXON & VANDERHYE

(57) ABSTRACT

Detonator spool including at least one body configured to receive a cable wound around the body, the body including at least one housing configured to receive a primer, an electronic control module housing configured to receive an electronic control module, and a bore forming a hub configured to rotate the body of the spool; and detonator including such a spool.

13 Claims, 12 Drawing Sheets

ELECTRONIC DETONATOR SPOOL AND DETONATOR COMPRISING SUCH A SPOOL

CROSS-REFERENCE TO RELATED APPLICATIONS

This application is the U.S. national phase of International Application No. PCT/FR2022/051637 filed Aug. 31, 2022, which designated the U.S. and claims priority to FR 2109153 filed Sep. 1, 2021, the entire contents of each of which are hereby incorporated by reference.

BACKGROUND OF THE INVENTION

Field of the Invention

The invention relates to an electronic detonator spool.

In particular, it relates to an electronic detonator spool with no bus wire.

The invention finds application in the field of pyrotechnic initiation, in any sector where a network of at least one detonator conventionally has to be implemented. Typical examples of use relate to the exploitation of mines, quarries, seismic exploration, or the building and public work sector.

Description of the Related Art

A detonator, with no bus wire, includes for example two functional entities: a primer, and an electronic control module.

In general, the primer includes an explosive composition as well as an electronic module, and this electronic module is configured to communicate with the electronic control module, for example thanks to a cable therebetween.

During the use of the detonator, the primer is placed in an explosive cartridge (often referred to as "booster"), itself housed in a location arranged to receive it and intended to be loaded with explosive. Such a location is for example a hole drilled in a wall, for example a floor or a wall, or even a ceiling.

The electronic control module, connected by the cable to the primer, in use, is placed at the outlet of the hole and is configured to receive test and/or firing signals, for example originating from a control and/or programming console.

These signals can be communicated wirelessly, for example by radio or light signal between the control and/or programming console and the electronic module.

To install the primer, and the electronic module, the cable intended to connect them is for example wound around a spool; and to unwind it, a tool, like a screwdriver or a simple stick, is fitted into a central barrel of a body of the spool, which allows making the body of the spool rotate easily about its axis to unwind the cable.

Moreover, for a detonator with no bus wire, the electronic control module has to be positioned as accurately as possible, in particular it has to be oriented at best towards the control and/or programming console; failing that, a communication range is reduced, and possibly the communication cannot be established, or is cut.

Hence, a need has arisen to improve and/or facilitate the set-up of an electronic detonator, in particular with no wire bus or with no surface connection.

Nevertheless, it has turned out to be desirable to impact the practice of a user as little as possible.

BRIEF SUMMARY OF THE INVENTION

In this context, an objective of the present invention is to overcome the aforementioned drawbacks at least in part, while also allowing for other advantages.

To this end, according to a first aspect, a detonator spool is provided including at least one body, for example cylindrical, configured to receive a cable wound around the body, in particular a connection cable between a primer and an electronic control module of the detonator.

According to an interesting aspect, the body of the spool includes at least one housing configured to receive a primer.

According to an interesting aspect, the body of the spool includes at least one electronic control module housing configured to receive an electronic control module.

According to an interesting aspect, the body of the spool includes at least one bore forming a hub configured to make the body of the spool rotate.

Such a bore is then preferably formed at the middle of the spool.

In one embodiment, the bore forming a hub includes the housing configured to receive the primer.

Such an arrangement allows housing the primer more to the centre of the spool, which enables the primers to be furthest from one another when several detonators, in particular several spools, are stored in a box, for example a storage cardboard box.

For example, the electronic control module housing includes at least one slot extending according to an axis of the body.

For example, the electronic control module housing, and/or the housing configured to receive the primer opens out at least at one end of the body.

According to an interesting feature of the invention, the spool includes at least one housing configured to receive a stake, the stake being configured to form a pivot connection with the bore forming a hub.

The stake may be held by simple mechanical adjustment, for example a size of the stake is adjusted to a compartment of the spool body, by a slide system inside a compartment, or by form-fitting into a housing of one end of the stake.

According to an interesting feature of the invention, the spool includes a cap configured to be fastened to a first end of the body of the spool.

For example, the cap includes an inner face and an outer face, opposite to the inner face.

For example, the inner face includes a fastening system configured to fasten the cap to the first end of the body of the spool.

For example, the spool includes a fin collar which surrounds the first end of the body of the spool.

For example, the cap includes a system for fastening the electronic control module, the fastening system being configured to fasten the electronic control module to the cap.

For example, the inner face of the cap includes the system for fastening the electronic control module.

For example, the cap includes a first system for fastening the stake, the first fastening system being configured to fasten the stake to the cap at a first location.

For example, the first fastening system is configured to fasten the stake to the cap, extending from the inner face of the cap.

For example, the cap includes a second system for fastening the stake, the second fastening system being configured to fasten the stake to the cap, at a second location, in particular by extending from the outer face of the cap.

In particular, the second location is distinct from the first location.

Thus, the cap is for example configured to hold the electronic control module on one face, herein the inner face, and the stake on another face, herein the outer face.

When the stake is planted in a wall, the electronic control module could then be held according to a desired altitude and orientation, on the cap, and it could possibly be extracted from the spool.

According to another example, the spool includes a finned cap, the finned cap includes a central portion, for example of circular shape (a flange), and a fin collar surrounding the central portion.

For example, the finned cap is configured to be fastened to a second end of the body of the spool, in particular in a storage configuration.

Thus, the general structure of the spool is barely impacted, but it is re-arranged so as to add different housings thereto contributing in assisting in the deployment of a detonator.

Furthermore, it has been found that a spool body with a relatively small diameter makes unwinding more difficult as the ambient temperature is low, especially when the temperature falls below 0° C.

Hence, it is preferable to have a spool body with the largest possible diameter, taking into account the context and the other design constraints that might exist.

Yet, the larger the diameter of the spool body, the more it could have a lost volume inside the body of the spool.

Hence, the present invention, according to any one of its features, is interesting in that it exploits this inner volume and thus allows avoiding loss thereof.

In a particular embodiment, the spool includes the stake.

For example, the stake includes a portion configured to cooperate with the bore to form the pivot connection, and at least one stop, configured to limit an insertion of the stake into the bore.

For example, the stake includes a conical portion which is configured to form the stop.

For example, the stop includes a conical section extending from the portion configured to form the pivot connection with the bore.

According to still another interesting option, the stake includes an electrical connector.

For example, the electrical connector is configured to connect an energy portion to an electronic circuit functional portion, at least the functional portion being included in the electronic control module.

For example, the electrical connector of the stake includes a metal strip, for example a leaf spring.

According to one embodiment, the stake includes the energy portion.

For example, the spool has a storage configuration, and in this configuration the stake is inserted into its housing.

For example, the stake is fastened at the first location, by the first fastening system of the cap.

According to another aspect, an electronic detonator is also provided including an electronic control module, an explosive primer, and a connection cable connecting the primer and the electronic control module, the detonator further including a spool according to any one of the previously-described features.

The electronic control module herein refers to a wireless electronic detonator surface module (connection bus), for example including a functional module including an electronic board provided with an electronic circuit, for example a radio and/or optical (light) signal communication module.

Possibly, the electronic module includes a protective coating, for example a case, which could optionally serve as a mechanical support configured to hold the functional module in the corresponding housing of the spool.

According to one embodiment, the electronic control module, and in particular the functional module, includes at least one electronic circuit functional portion.

When the functional portion of the electronic circuit is electrically connected to an electronic circuit energy portion, then the electronic control module could be activated. The energy portion herein refers to an electronic circuit portion including, for example, an energy source, for example a battery.

For example, the electronic circuit functional portion includes an electrical contact pad.

For example, the energy portion includes an electrical contact pad.

For example, the electronic control module, in particular its electronic circuit, includes at least one connection interface, in particular with the stake as described later on; the connection interface is for example configured to be connected to an electrical connector of the stake, as described later on.

For example, the connection interface of the electronic control module includes the contact pad of the functional portion of the electronic control module.

For example, the connection interface of the electronic control module, and possibly more particularly the electrical contact pad of the functional portion, includes a push-button.

According to an interesting option, the electronic control module, and in particular the functional module, further includes the electronic circuit energy portion.

For example, the connection interface of the electronic control module then further includes the contact pad of the energy portion.

According to a particularly interesting embodiment, the detonator includes a storage configuration.

In the storage configuration, the electronic control module is housed in the housing of the corresponding spool, i.e. in the electronic control module housing of the spool.

For example, the electronic control module is fully stowed into the body of the spool.

For example, the electronic control module is held in the housing by clamping.

For example, the primer is housed in the corresponding housing of the spool.

For example, the connection cable between the electronic control module and the primer is wound around the body of the spool.

According to an interesting option, the cap is fastened to the first end of the body of the spool.

According to an interesting option, the finned cap is fastened to the second end of the body of the spool.

For example, the electronic control module is fastened to the cap, for example to the inner face of the cap.

For example, the stake is fastened to the cap, for example to the inner face of the cap, for example by the first fastening system of the stake.

For example, the stake is housed, in its housing, in the body of the spool.

According to another interesting example, the detonator includes an installation configuration.

Preferably, in this configuration, the stake is extracted from its housing of the spool.

Preferably, the primer is also extracted from its housing of the spool.

In the installation configuration, a portion of the stake is for example inserted into the bore forming a hub of the spool, and the stake and the bore thus form a pivot connection configured to make the body of the spool rotate around the stake, which allows unwinding the cable where appropriate.

According to still another interesting example, the detonator includes a use configuration.

In the use configuration, the primer has for example been placed at the bottom of a hole formed in a wall, and is connected by the cable to the electronic control module which lies at the outlet of the hole, for example at the surface of the wall.

The electronic control module can then be placed in the desired position (orientation and altitude), for example oriented towards a control and/or programming console.

In this configuration, the electronic control module can be activated afterwards by a control and/or programming console for example.

For example, the electronic control module can be extracted at least in part from its housing of the body of the spool.

For example, at least one portion of the electronic control module remains in the corresponding housing and is for example held by clamping in the housing in the body of the spool.

If the cable is completely unwound, the electronic control module could remain in the body of the spool.

For example, the electronic control module is fastened to the inner face of the cap.

In particular example of use, in particular if the cable has been completely unwound, the electronic control module fastened to an inner face of the cap is further stowed into its housing of the spool body, i.e. the cap remains fastened to the first end of the spool body, and the spool is fastened at the outlet of the hole by the fin collar which surrounds the first end of the spool body. The stake could then be not-used.

According to one option, the stake is for example fastened to the cap, for example to the outer face of the cap, for example by the second fastening system of the stake.

For example, the stake is then fastened to the cap by a head of the stake.

In this configuration, the stake can then be pushed into a wall to hold the electronic control module, then fastened to the cap, in particular to the inner face of the cap.

According to another interesting option, the stake is fastened to the finned cap.

Where necessary, the finned cap is for example dissociated from the spool body, and for example inserted at the outlet of the hole into which the primer is inserted.

For example, the stake is then fastened to the finned cap by a rod of the stake.

In an embodiment, the stake is fastened by its rod to the finned cap and by its head to the cap, in particular to the outer face of the cap.

When the finned cap is fastened at the outlet of the hole, the cap could then be held at a distance from the outlet of the hole.

And for example, the electronic control module is then also fastened to the cap, in particular to the inner face of the cap as described before.

Thus, a detonator including a spool according to the invention allows integrating a tool (herein the stake) within the spool, which, where necessary, allows unwinding the spool and/or setting a distance between a ground (or a wall) and the electronic module. The stake also allows for a better control of the position, in altitude and in orientation, of the electronic control module, which promotes good communication with a control and/or programming console.

In one embodiment, the stake includes an electrical connector, as mentioned before.

For example, the electrical connector is configured to connect the energy portion to the functional portion of an electronic circuit, in particular to close the electronic circuit of the electronic control module.

For example, when fastening the stake on the cap, while the electronic control module is fastened on the inner face of the cap, the stake closes the electronic circuit of the electronic control module and triggers energising thereof.

For example, in particular in the use configuration, the electrical connector of the stake is electrically connected to the connection interface of the electronic control module.

This allows electrically connecting the energy portion to the functional portion of the electronic control module.

In one embodiment where the functional module includes both the functional portion and the energy portion, then the electrical connector allows electrically connecting the contact pad of the functional portion to the contact pad of the energy portion.

According to another embodiment, the stake includes the energy portion, and the electrical connector is connected to the energy portion within the stake.

Thus, for example, in particular in the use configuration, the electrical connector of the stake is electrically connected to the connection interface of the electronic control module which includes the contact pad of the functional portion.

BRIEF DESCRIPTION OF THE DRAWINGS

The invention, according to one embodiment, will be well understood and its advantages will appear better upon reading the following detailed description, given for indicative and non-limiting purposes, with reference to the appended drawings, wherein:

FIGS. 8A to 8C, depicts the stake which has been extracted from the spool which is inserted through the cap assembled to the body of the spool;

FIGS. 9A to 9D, depicts the stake which has been extracted from the spool which is connected to the cap initially assembled to the body of the spool in order to extract the electronic control module fastened thereto;

FIGS. 10A to 10C, depicts a connection between the stake and the electronic control module according to one embodiment;

FIGS. 11A to 11D, depicts the stake which has been extracted from the spool which is connected to the finned cap initially assembled to the body of the spool to detach it therefrom.

DETAILED DESCRIPTION OF THE PREFERRED EMBODIMENTS

Figure 1:
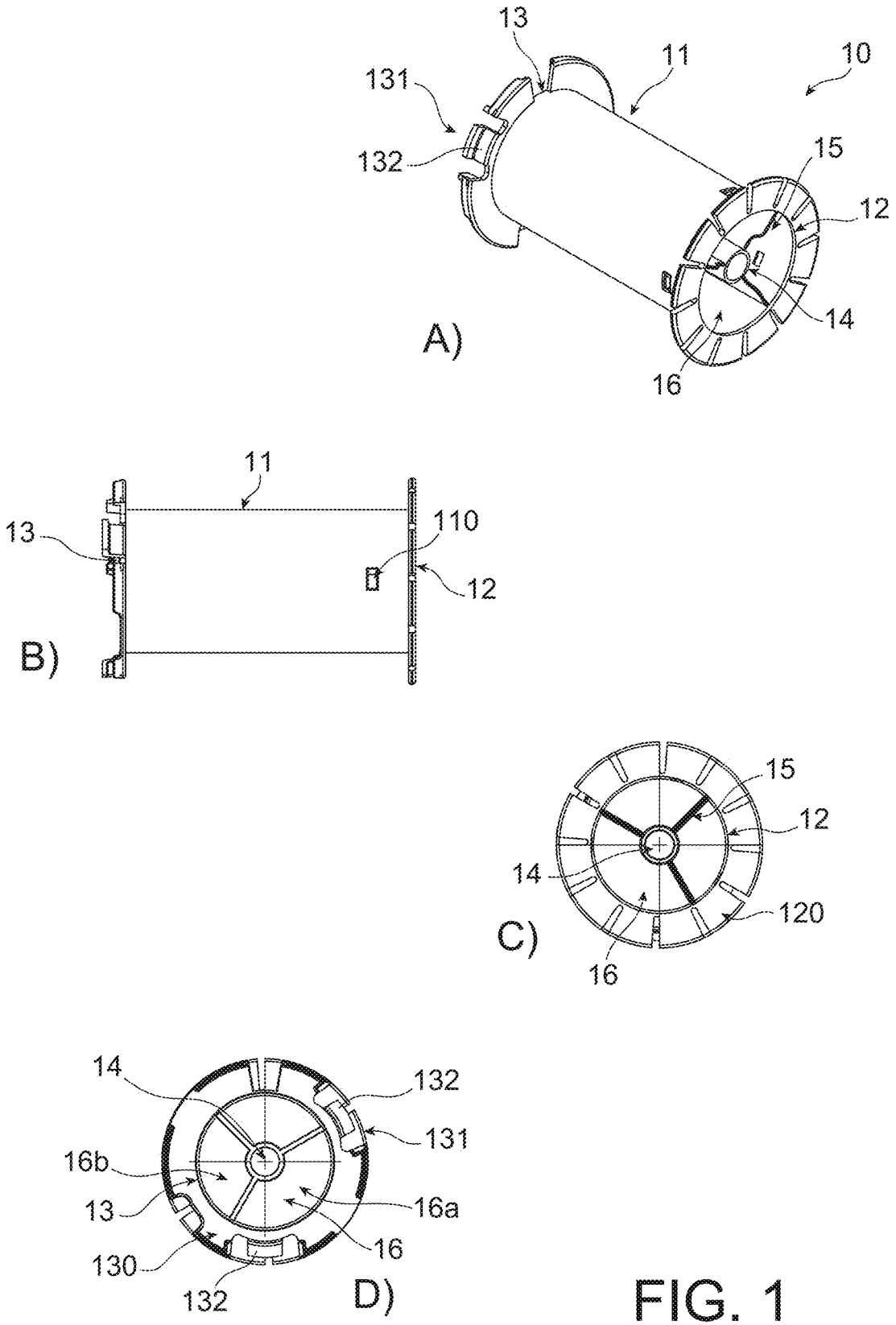
FIG. 1 shows a spool according to an embodiment of the invention, respectively depicted in perspective view (FIG. 1A), in profile view (FIG. 1B), in bottom view (FIG. 1C) and in top view (FIG. 1D)

FIG. 1 illustrates an embodiment of a detonator spool 10 according to an embodiment of the invention, respectively depicted in perspective view (FIG. 1A), in profile view (FIG. 1B) and, by definition in bottom view (FIG. 1C) and top view (FIG. 1D).

The spool 10 primarily includes a body 11.

The body 11 is herein formed of a cylindrical envelope with a circular outer section extending longitudinally between two ends: a first end 12, and a second end 13.

As best shown in FIG. 1B, the body 11 herein includes a perforation 110.

The perforation 110 is configured to hook a fastening system 210 of a cap 20, described with reference to FIG. 2.

By definition, the first end is considered to lie below the spool, whereas the second end is considered to lie above the spool.

The expressions above and below are herein arbitrary, chosen for convenience of description.

The first end 12 is illustrated, in planar view, i.e. according to a bottom view of the spool, in FIG. 1C.

Thus, as shown in FIGS. 1A and 1C, the spool herein includes a fin collar 120 which surrounds the first end 12 of the body.

In particular, this fin collar 120 is configured to form an axial stop for a cable that would be wound around the body 11 of the spool.

Furthermore, the fin collar 120 is herein configured to promote positioning of the spool, for example on a wall or more particularly at an outlet of a drill hole, as desired.

The second end 13 is illustrated, in planar view, i.e. in a top view of the spool, in FIG. 1D.

As shown in FIGS. 1A and 1 D in particular, the spool herein includes a collar 130 which surrounds the second end 13 of the body.

Similarly, this collar 130 is in particular configured to form an axial stop for the cable that would be wound around the body 11 of the spool.

Thus, a wound cable is held between the fin collar 120 and the collar 130.

The collar 130 herein further includes a hooking system 131.

The hooking system 131 is in particular configured to hold an end of the cable when it is wound around the body of the spool and thus avoid an unintentional unwinding thereof, in particular in a storage configuration of the detonator.

For example, the hooking system 131 herein includes two curved stops 132 which extend from the collar 130.

The spool further includes a bore 14 which is herein formed by a tube positioned according to a central axis of the body of the spool.

Thus, the bore 14 is configured to form a hub and in particular to insert a stake 40 therein, described with reference to FIG. 4, so as to form a pivot connection to make the body of the spool rotate, in particular to unwind the cable.

Furthermore, the bore 14 may also be configured to house a detonator primer therein, in particular in the detonator storage configuration. The primer is then protected during transport.

It is then removed beforehand in order to insert the stake therein where necessary.

As best shown in FIGS. 1C and 1D in particular, the spool includes different reinforcements 15.

The reinforcements 15 herein connect the tube forming the bore to the spool body, in particular to the envelope of the body.

The reinforcements 15 also allow compartmentalising an internal space of the body 11, and thus forming housings 16 within the spool, herein three housings 16.

Thus, the housings 16 are empty spaces between the reinforcements 15.

Two of the reinforcements 15 are more radially spaced apart than the other reinforcements with respect to one another so as to form a housing 16*a* larger than the others; such a housing 16*a* thus facilitates the insertion of an electronic control module.

Hence, the housing 16*a* is herein deduced as being the largest one of the housings 16.

In this case, the other housings 16*b* have the same size. They could indifferently receive the stake 40, for example. In this case, the housing 16*b* configured to accommodate the stake 40 is deduced from the position of the element for fastening the stake on the cap 20, as described later on.

Thus, each part fits into the corresponding compartment depending on the orientation of the cap 20 with respect to the body of the spool (which could have the housings to fasten the different elements therein).

Thus, the housing 16 a, herein delimited radially by the envelope of the body 11 and two reinforcements 15, is herein configured to receive an electronic control module 50, described with reference to FIG. 5.

The housing 16*b*, herein delimited radially by the envelope of the body 11 and two other reinforcements 15, is for example herein configured to house the stake 40 therein, in particular in the storage configuration of the detonator.

Figure 2:
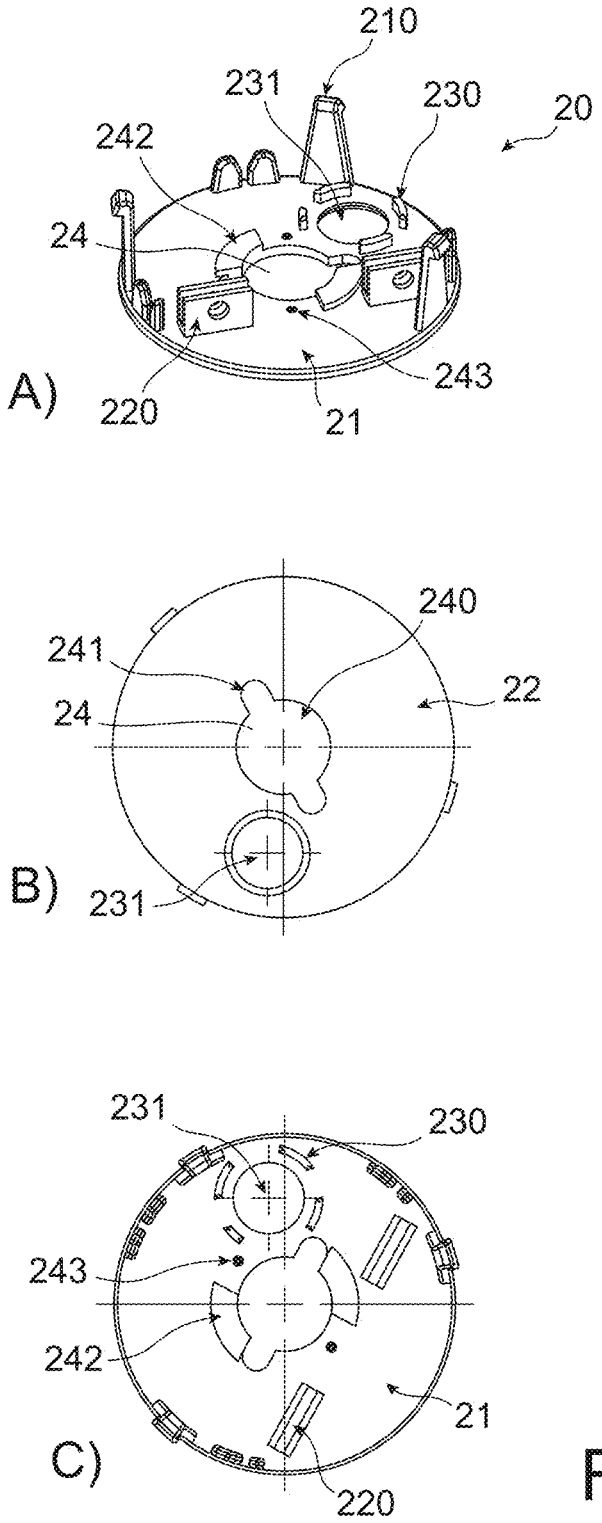
FIG. 2 shows a cap according to one embodiment, respectively depicted in perspective view (FIG. 2A), according to its outer face (FIG. 2B), and according to its inner face (FIG. 2C)

FIG. 2 illustrates the cap 20 according to an embodiment of the invention.

The cap 20 includes an inner face 21 and an outer face 22, opposite to the inner face.

As shown in FIGS. 2A and 2C, the cap includes a fastening system 210 configured to fasten the cap 20 to the body of the spool, in particular to close the body of the spool at its first end 12.

In particular, the fastening system 210 herein extends from the inner face 21, and is configured to cooperate with the perforations 110 formed in the body of the spool.

The inner face 21 of the cap 20 further includes a fastening system 220 configured to fasten the electronic module 50 to the cap.

In this case, it primarily includes a slot configured to insert the electronic module 50 therein.

The cap 20 herein also includes a first system for fastening the stake 230. The first system for fastening the stake 230 is configured to fasten the stake 40 to the cap 20 at a first location and extending from the inner face 21.

The first system for fastening the stake 230 includes, for example, in this case spaced pins which are configured to hold the stake 40, for example a head of the stake, by clamping.

Furthermore, the cap 20 herein includes an opening 231.

The opening 231 crosses a thickness of the cap 20. In addition, it is herein surrounded by the first system for fastening the stake 230, in particular by the pins, on the side of the inner face 21.

Thus, when the stake 40 is fastened to the first location of the cap, it is possible to dislodge it by inserting a tool or a finger through the opening 231 and by pushing the stake 40 back.

The cap further includes a second system for fastening the stake 240.

The second fastening system 240 is configured to fasten the stake 40 to the cap at a second location, the second location being distinct from the first location, and with the stake extending from the outer face 22 of the cap.

In particular, the second system for fastening the stake 240 includes a window 24, crossing a thickness of the cap and geometrically centred with respect to the cap.

Thus, when the cap is assembled to the spool body, the window 24 faces the bore 14.

The window 24 includes a central portion mainly circular shaped, and two ears 241 extending from the central portion and diametrically opposite to one another.

As shown in FIGS. 2A and 2C, the second system for fastening the stake 240 also includes a stop 242, which is herein formed into two diametrically opposite portions, and extend from an ear 241 on the side of the inner face 21.

Thus, the stop 242 is configured to stop a rotation of the stake, and also to impose, in which direction, the stake should be rotated in order to lock it in position at the second location.

In the present embodiment, the second system for fastening the stake 240 also includes a lug 243. The lug 243 is herein formed by a half-sphere in excess thickness with respect to the inner face 21 and is configured to limit a return of the stake in rotation. Thus, it contributes to holding it in position by clamping.

Thus, as described hereinafter, a head of the stake 40 with a shape complementary to the window 24 is thus configured to be inserted through the window 24 and to be locked in position by pivoting the stake.

Figure 3:
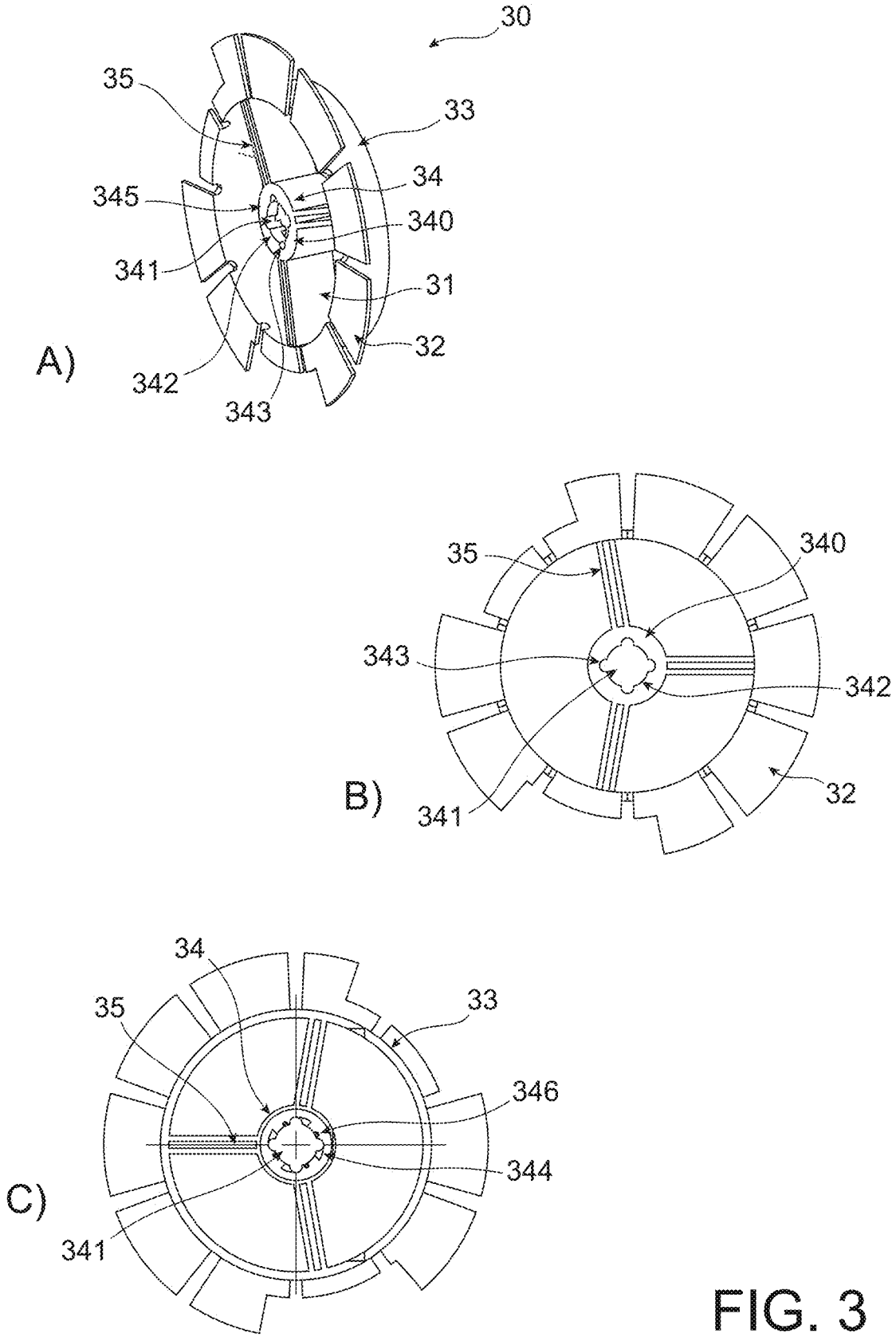
FIG. 3 shows a finned cap according to one embodiment, respectively depicted in perspective view (FIG. 3A), according to its outer face (FIG. 3B), and according to its inner face (FIG. 3C)

FIG. 3 illustrates a finned cap 30.

The finned cap 30 is configured to be fastened to the second end 13 of the body 11 of the spool 10.

The finned cap 30 includes a central portion 31, for example circular shaped (a flange), and a fin collar 32 surrounding the central portion.

The central portion 31 herein includes a peripheral rim 33, a tube 34, centred with respect to the peripheral rim, and reinforcements 35 connecting the tube 34 to the peripheral rim 33.

The tube 34 herein includes a fastening system 340 configured to fasten the stake to the finned cap.

The fastening system 340 herein includes a wall 345, transverse to the tube 34, which includes a cutout 341 including a main portion 342 with a circular section and four lobes 343, evenly spaced apart.

On the side of an inner face shown in FIG. 3C, the wall 345 further includes at least one stop 344 extending along an edge of the main part 342 of the cutout 341 from a lobe 343. Like with the cap 20, the stop 344 is thus configured to stop a rotation of the stake, and also to impose in which direction the stake should be rotated to lock it in position on the finned cap 30.

On this same side, the wall 345 further includes at least one lug 346. The lug 346 is herein also formed by a half-sphere in excess thickness with respect to the wall 345 and is configured to limit a return of the stake in rotation. Thus, it contributes to holding it in position by clamping.

As described hereinbelow, the fastening system 340 allows inserting and fastening the stake 40 to the finned cap, in particular a rod 42 of the stake 40.

The fin collar 32 is herein configured to cooperate with the collar 130 of the body of the spool 10.

In particular, the fin collar 32 includes notches formed by some fins shorter than others.

These notches are configured to be placed opposite the curved stops 132 of the collar 130.

Afterwards, the finned cap 30 is fastened to the body of the spool by insertion and clamping.

Figure 4:
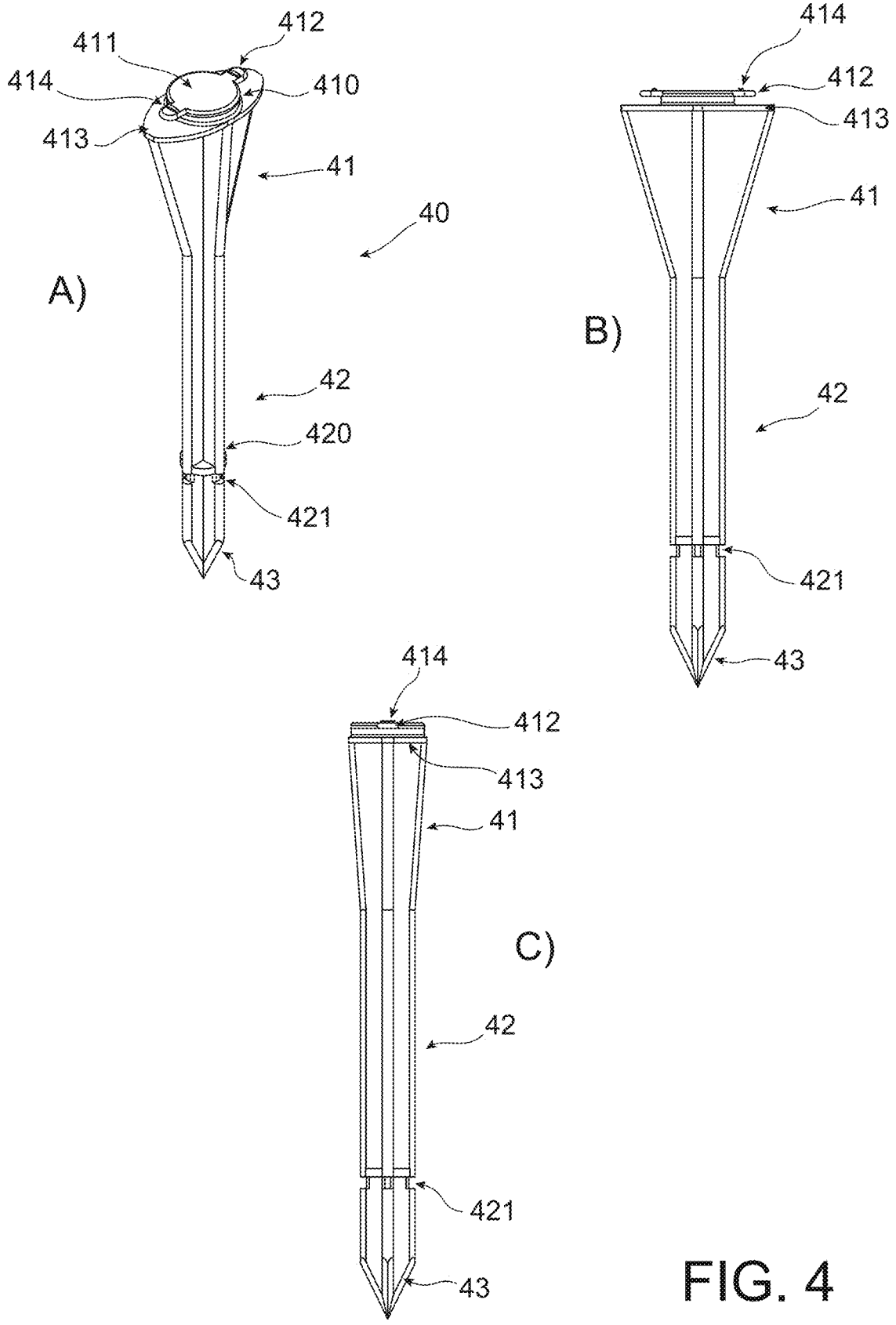
FIG. 4 shows a stake according to one embodiment, respectively depicted in perspective view (FIG. 4A), according to a first profile (FIG. 4B), and according to a second profile orthogonally to the first one (FIG. 4C)

FIG. 4 illustrates the stake 40 according to one embodiment.

The stake 40 herein primarily includes a head 41, and a rod 42 extending from the head and terminated in a tip 43.

In general, the stake 40 herein has a cross-like shaped cross-section, here with four orthogonal branches, diametrically opposite in pairs.

Preferably, a branch has a rounded edge to facilitate pivoting of at least one portion of the stake 40 in the bore 14 of the spool body.

The head 41 includes a conical portion, flaring from the rod, and herein terminating in a plate 413.

As illustrated in FIG. 4A, the plate 413 has an oval shape.

The conical portion then includes for example two diametrically opposite branches, a height of which with respect to a centre of the stake is larger than the other two branches.

Surmounting the plate, the head includes a locking pin 410.

The locking pin 410 includes a main portion 411, cylindrical with a circular section, and herein two fingers 412 extending diametrically opposite to one another from an upper surface of the main portion, and at a distance from the plate 413.

Thus, the locking pin 410 is for example configured to be inserted into the opening 24 of the cap and the fingers 412 allow fastening the stake 40 by making it pivot, the fingers 412 then sliding over the inner face 21 until bearing on the stops 242 whereas the plate 413 bears against the outer face 22 of the cap 20.

The locking pin 410 is also configured to be wedged in the first fastening system 230, the upper surface of the main portion 411 then facing the opening 231.

Hence, it is thus easy to press on the upper surface of the main portion 411 through the opening 231 to dislodge the stake and possibly to extract it from the body of the spool 10.

Starting from the head 41, the rod 42 includes a main section 420 with constant section which forms the portion configured to cooperate with the bore of the body of the spool to allow making the body of the spool rotate.

The rod 42 further includes a circumferential notch 421, formed between the main section 420 and the tip 43.

Thus, the notch 421 forms a double axial stop, since when the rod 42 is inserted into the cutout 341 of the finned cap 30 and is pivoted, then the rod is immobilised axially with respect to the finned cap 30.

In particular, the notch 421 is configured to cooperate with the wall 345 of the finned cap 30.

Indeed, by inserting the rod through the cutout 341 of the wall 345 of the finned cap 30, the branches extending between the tip 43 and the circumferential notch 421 pass through the lobes 343 and the main section 420 then abuts against the wall 345. Then, by pivoting the stake, one end of the branches extending from the tip 43 fits and slides over the inner face of the wall 345 until bearing on the stops 344.

The wall 345 is then wedged in the circumferential notch 421.

It is then possible to pull the stake 40 which thus drives the finned cap 30, which dissociates from the body of the spool 10.

According to an interesting option illustrated herein, the stake 40 includes an electrical connector 414.

The electrical connector 414 herein includes a metal strip embedded at the surface of the fingers 412.

Figure 5:
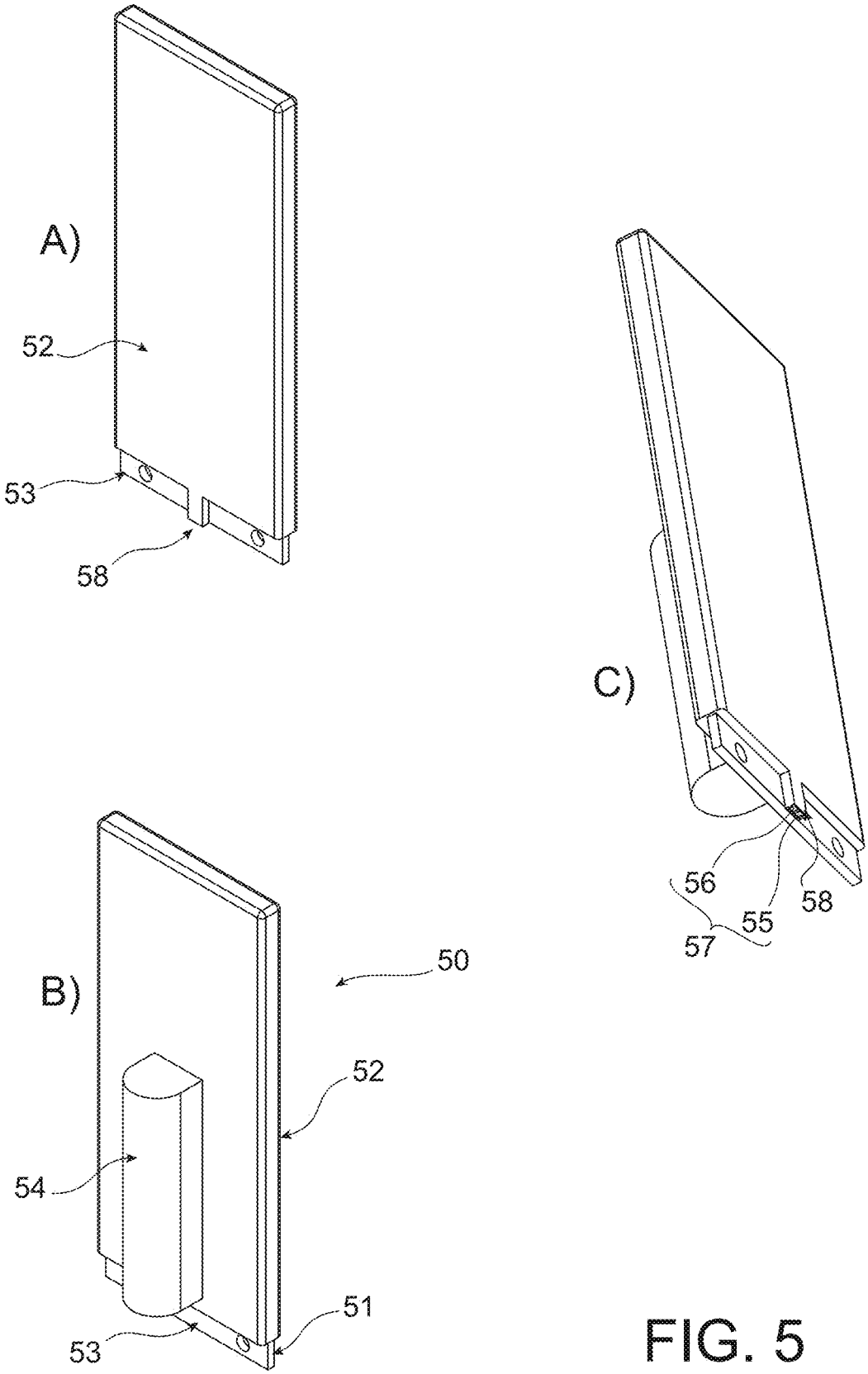
FIG. 5 shows an electronic control module in perspective view, respectively, by definition, in recto (FIG. 5A), in verso (FIG. 5B), and according to a low-angle viewpoint (FIG. 5C)

FIG. 5 then very schematically illustrates an electronic control module 50.

The electronic control module 50 herein includes a functional module 51, for example herein an electronic board, which includes for example at least one radio signal communication module, configured to communicate with a console, whether a control console or a programming console, optionally an optical (light) communication module.

Furthermore, it herein includes a protective coating 52 (optional), configured to protect the functional module 51.

For example, the protective coating 52 is an overmoulding formed over the functional module 51.

In this case, the protective coating 52 partially covers the functional module 51, and a portion of the functional module 51 outside the protective coating 52 herein includes in particular a lower board 53 which is configured to be inserted in the fastening system 220 of the cap 20, in particular to cooperate with the slot to hold the electronic module in position on the cap 20.

In this case, the electronic control module 50, and in particular the functional module 51, includes an electronic circuit functional portion, as well as an energy portion.

For example, the energy portion includes a battery 54.

As illustrated in FIG. 5C, in the present embodiment, the functional portion of the electronic circuit incudes an electrical contact pad 55, and the energy portion includes an electrical contact pad 56.

The electrical contact pads 55, 56 herein form a connection interface 57 of the electronic control module.

Thus, the connection interface 57 is configured to be connected to the electrical connector 414 of the stake which thus allows electrically connecting the energy portion to the functional portion of the functional module when the detonator is in use configuration for example.

In this case, a portion of the protective coating 52 covers the connection interface, and further includes a bead 58 in excess thickness with respect to the connection interface 57.

The bead 58 contributes to contact sealing when the connection interface 57 is brought into contact with the electrical connector 414 of the stake (illustrated in FIG. 4).

FIGS. 6 to 11 then illustrate an assembly of the elements depicted in connection with FIGS. 1 to 5 and different possible configurations of a detonator according to an embodiment of the invention.

Thus, for example, FIG. 6A shows in perspective the spool 10 in the body of which the electronic module 50 and the stake 40 are housed, which are supported by the cap 20.

The primer 122 is disposed in the spool. Apart from the primer 122, the cable connecting it to the module 50 is not illustrated, the spool is then in a configuration corresponding to a storage configuration of the detonator.

In FIG. 6A, the finned cap 30 closes the second end of the body of the spool, whereas it has been removed in FIG. 6B.

Figure 6:
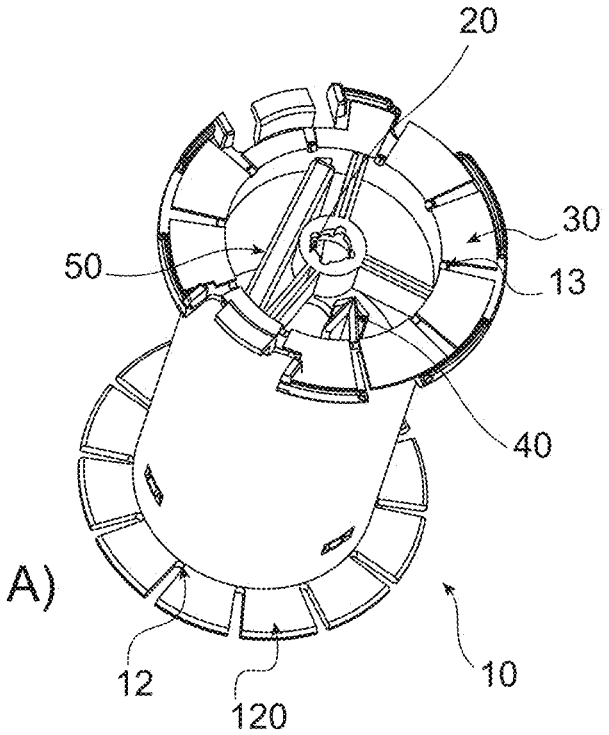
FIG. 6 shows the spool of FIG. 1 including the electronic module of FIG. 5 and the stake of FIG. 4, and respectively with (FIG. 6A) and without (FIG. 6B) the finned cap of FIG. 3 sealing one end of the body of the spool.
Figure 6:
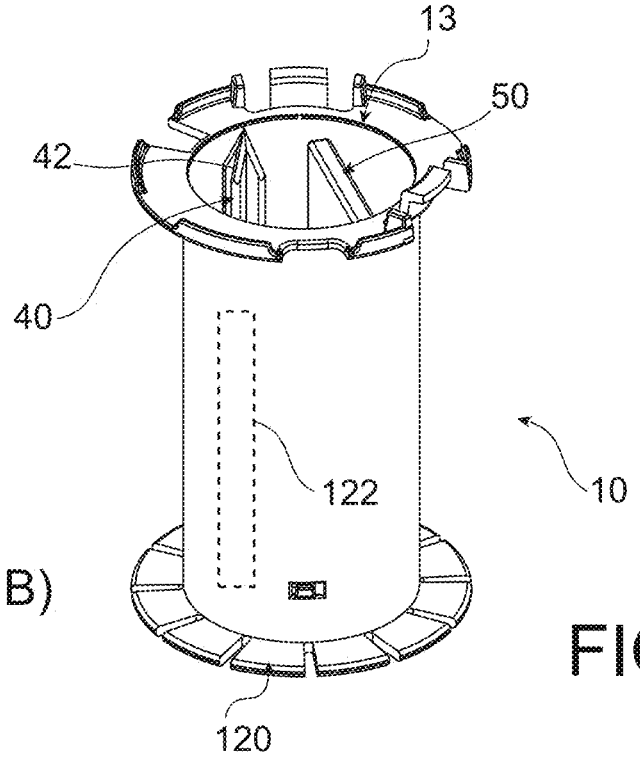
Figure 7:
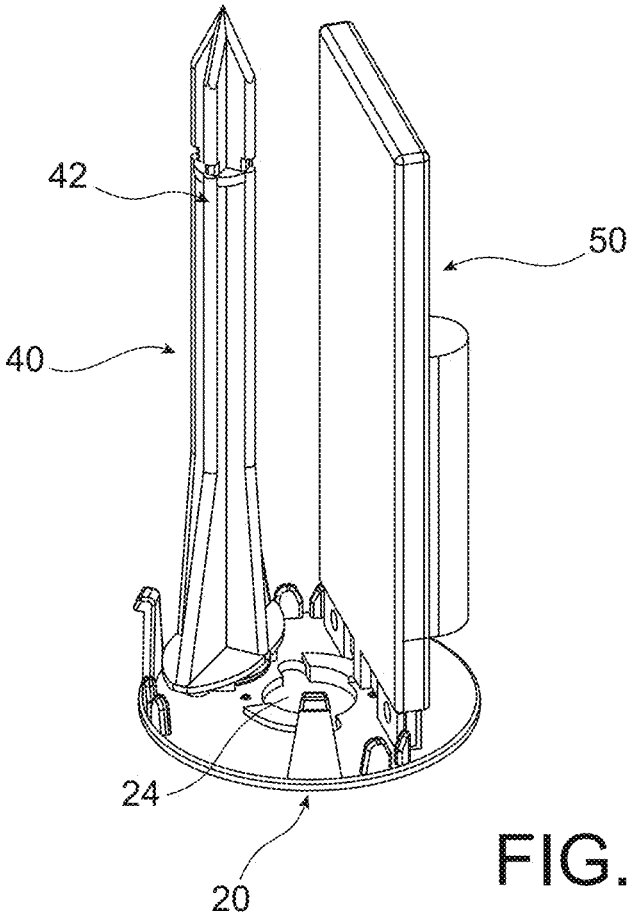
FIG. 7 shows the stake of FIG. 4 and the electronic module of FIG. 5 mounted on the cap of FIG. 2.

FIG. 7 illustrates the arrangement of the stake 40 and of the electronic module 50 fastened to the cap 20, in particular on its inner face 21, as they are when they are stowed into the body of the spool, as illustrated in FIG. 6.

As explained hereinabove, to extract the stake, it is therefore possible to push on its head through the opening 231 of the cap, or simply to pull it by the rod 42.

Moreover, the electronic control module 50 is held in the spool body at least partially thanks to the cap.

Yet, the cap is not indispensable and could be replaced by a simple slide system at the main compartment of the spool body to hold the electronic module by form-fitting.

Figure 8:
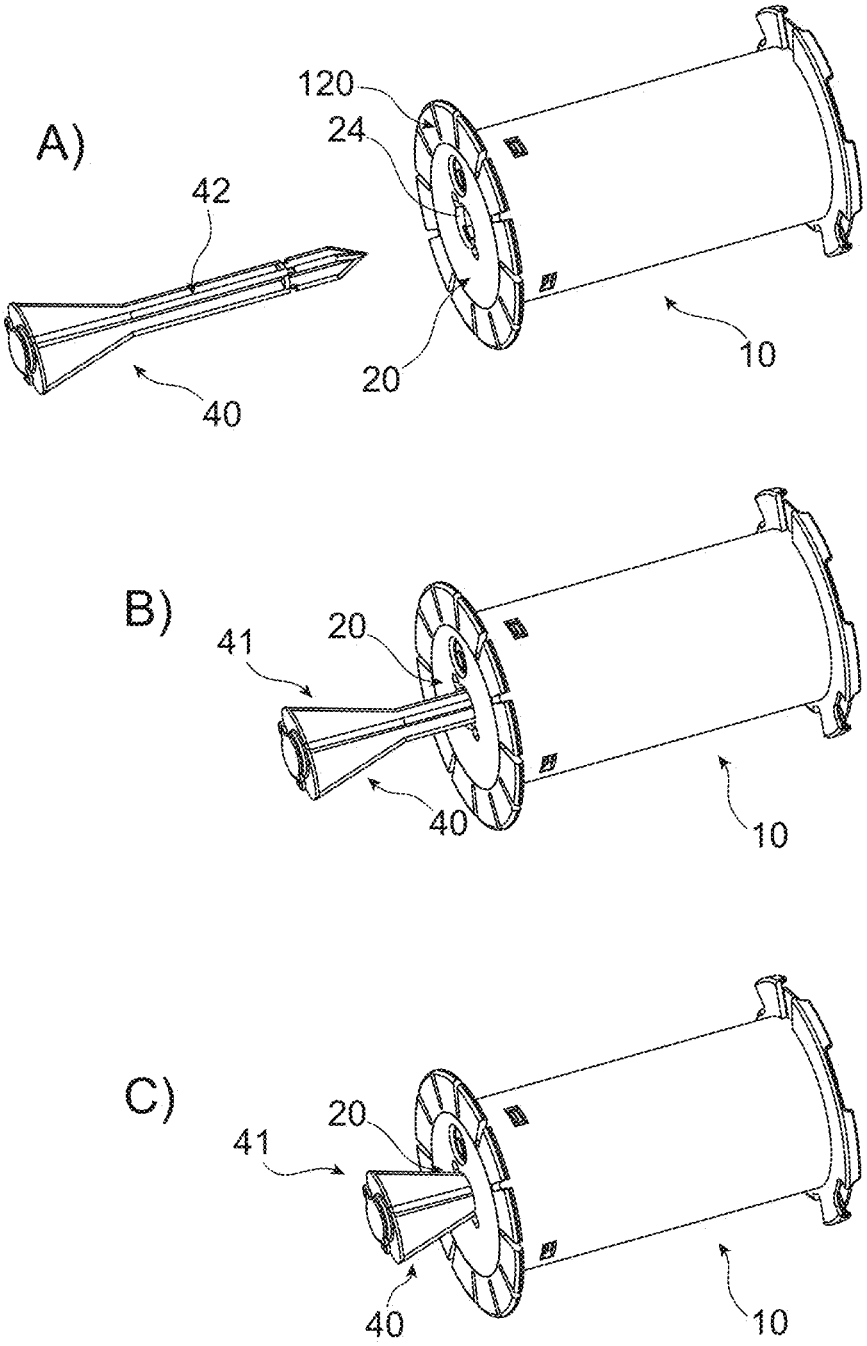
FIG. 8, including

FIG. 8 illustrates a positioning of the stake, for example for an installation configuration of a detonator, to make the body of the spool rotate.

For this purpose, the rod 42 of the stake is inserted into the window 24, and the conical portion of the head 41 of the stake abuts against the central portion of the window 24.

Thus, it is possible to make the body of the spool 10 rotate around the stake 40.

Figure 9:
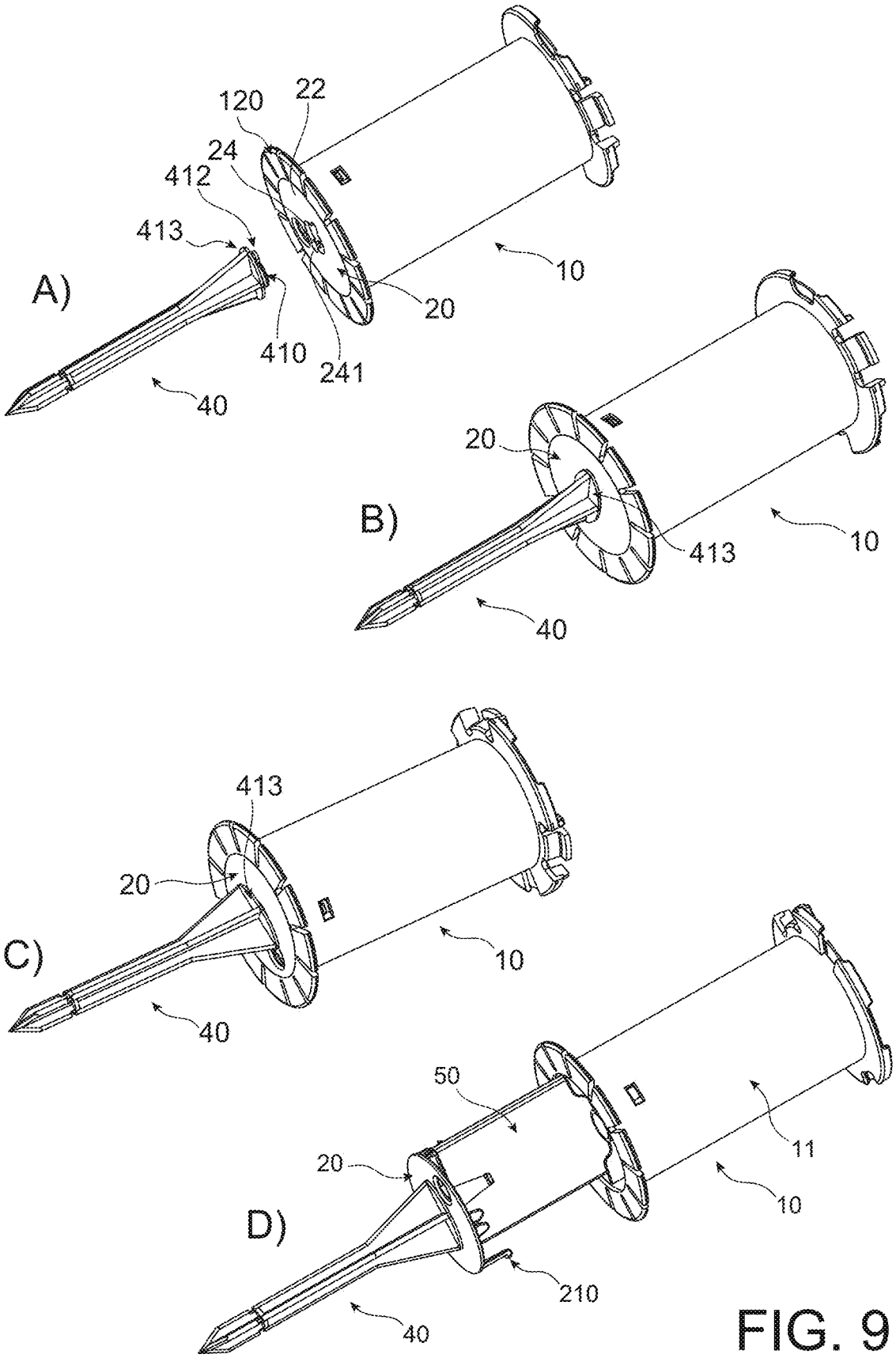
FIG. 9, including

FIG. 9 illustrates fastening of the stake 40 at its second location, and in order to extract the electronic module from the body of the spool.

The locking pin 410 of the head of the stake is directed so that the fingers 412 face the ears 241 of the window 24 (FIG. 9A).

The locking pin 410 could then be pushed into the window 24 until the plate 413 abuts against the outer surface 22 of the cap (FIG. 9B).

Afterwards, the stake is pivoted. On the side of the inner face, the fingers 412 slide over the inner face 21 until coming against the stops 242 (FIG. 9C).

The stake is then locked in position.

By pulling on the stake, the fastening system 210 of the cap is unhooked off the body 11 of the spool 10, and the cap 20 thus allows extracting, at least in part, the electronic control module 50 from the body 11 of the spool (FIG. 9D).

Figure 10:
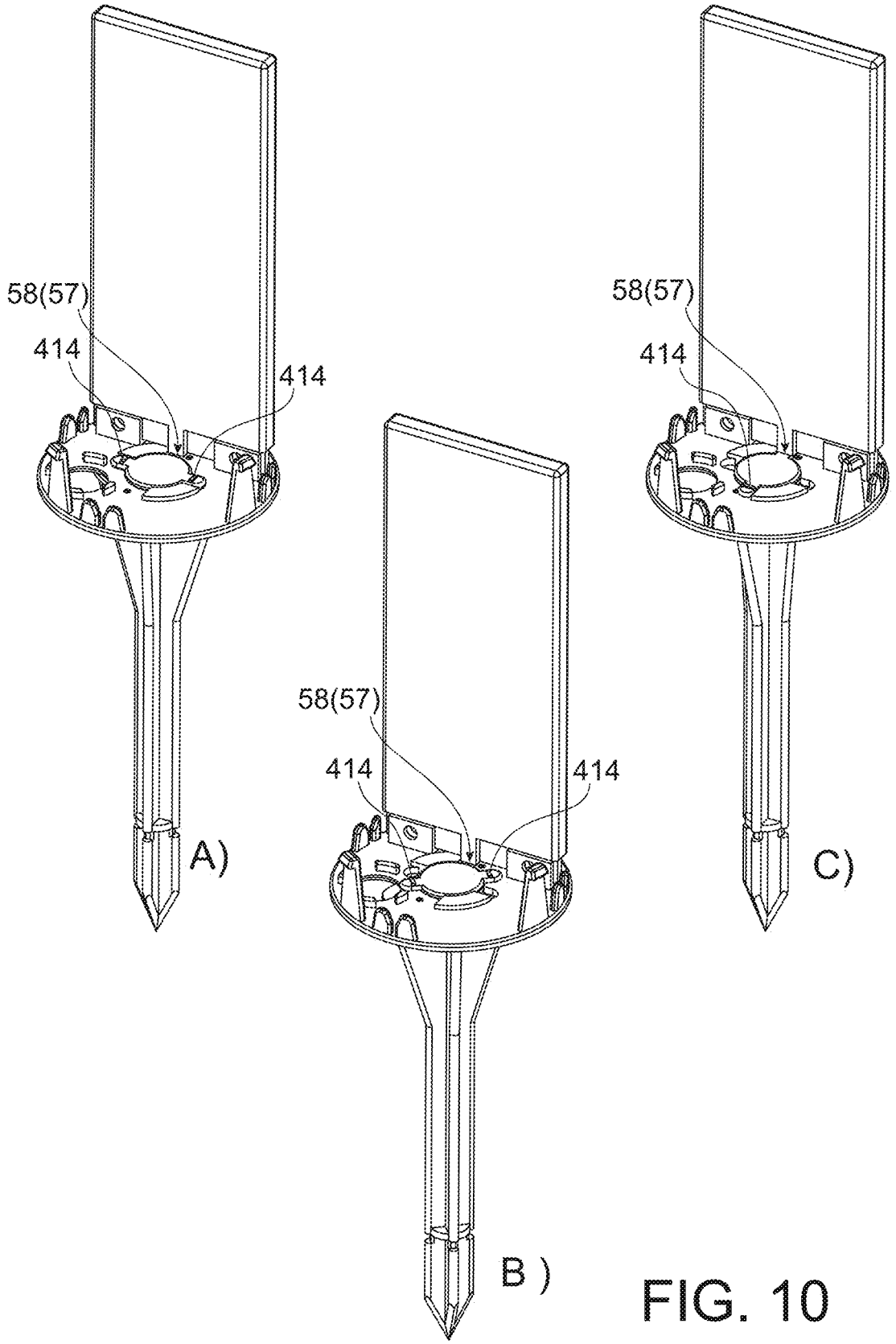
FIG. 10, including

In parallel, as illustrated in FIG. 10, the electrical connector 414 of the stake comes into contact with the connection interface 57. In this configuration, similar to a configuration of use of the detonator, the electrical connector 414 electrically connects the electrical contact pad 55 of the electronic circuit functional portion and the electrical contact pad 56 of the energy portion which are herein included in the functional module 51. Thus, the electronic control module 50 is activated.

Thus, the main function of the cap 20 is to hold the electronic module, and also enables connection to the stake 40.

The stake 40 locks onto the cap 20 supporting the electronic module 50, and it also allows bringing it away from the wall.

This function may also be achieved by a simple slide system (on the stake and the cap) without ensuring the locking function.

If the cable has been completely unwound from the spool, it is not necessary to extract the electronic module from the body of the spool; otherwise (Faraday cage effect), the stake fastened to the cap allows removing the electronic module from the body of the spool, as described hereinabove.

Afterwards, the stake assembly, the electronic module and the cap (with or without the spool body) are planted in a wall (for example in a heap of fine rocks, drill residues) thanks to the shape of the stake.

Figure 11:
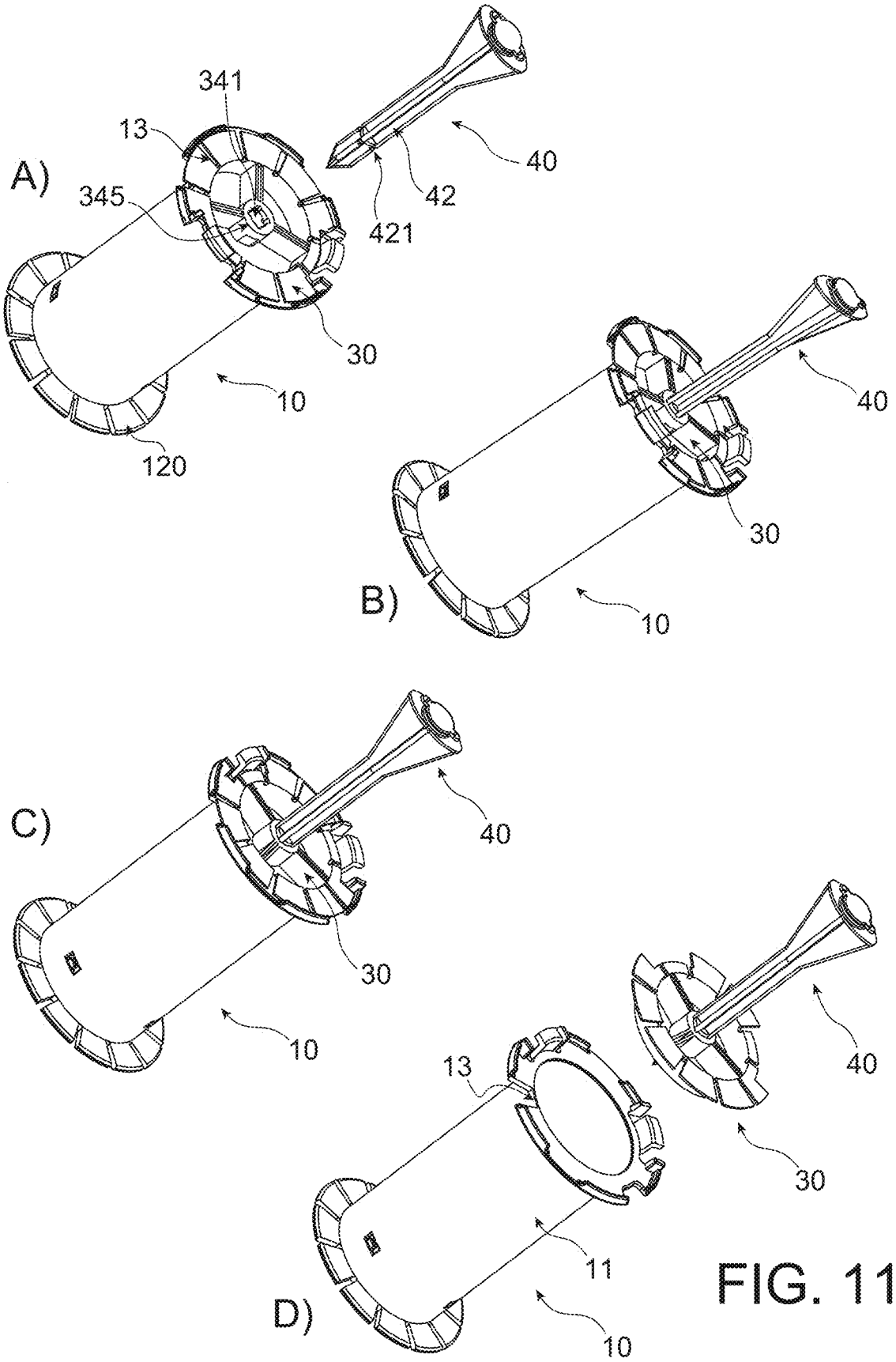
FIG. 11, including

Complementarily or alternatively, the stake 40 may be fastened to the finned cap 30 as shown in FIG. 11.

For this purpose, the rod 42 of the stake is inserted into the cutout 341 of the wall 345 of the finned cap (FIG. 11A) until a portion of the rod abuts against the wall 345 (FIG. 11B).

The stake is then pivoted (FIG. 11C), and the wall 345 is wedged in the circumferential notch 421.

It is then possible to dissociate the finned cap 30 from the body of the spool by pulling on the stake 40 (FIG. 11D).

Figure 12:
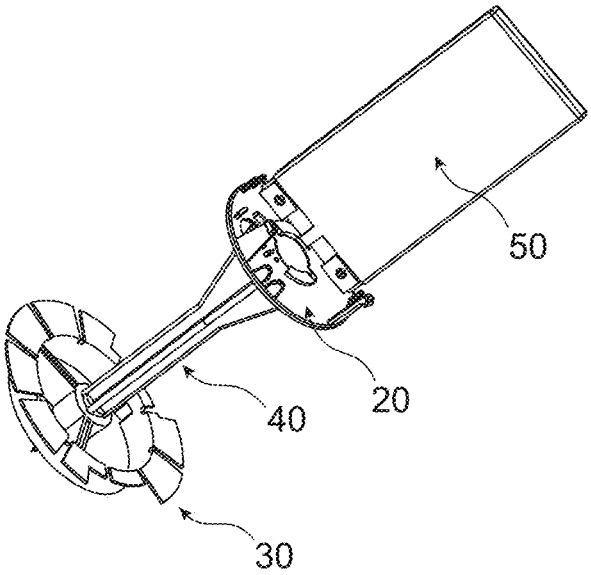
FIG. 12 shows the finned cap, the stake and the cap on which the electronic module is fastened assembled together.

Finally, FIG. 12 illustrates a combination of the arrangements illustrated in FIGS. 10 and 11.

The stake 40 is then fastened to both the cap 20 supporting the electronic module 50, and the finned cap 30.

For example, the finned cap 30 is particularly suited to be fastened at the outlet of a hole, for example a hole at the bottom of which the primer is positioned.

Moreover, such a configuration also allows guaranteeing a predefined height between the electronic module 50 and the wall. Indeed, the finned cap 30 then limits some sinking of the stake 40 in the wall, or in the hole.

FIG. 12 illustrates a use configuration without the spool; nonetheless, depending on unwinding of the cable, it is possible to leave the spool fastened to the cap 20.

For an underground application (for example for a hole drilled horizontally in the case of a tunnel-type gallery, or drilled vertically in a vault), the shape of the finned cap 30 proves to be useful, like the fin collar 120 of the spool.

According to a first example, if the cable is completely unwound, it is possible to use the finned cap 30 or the fin collar 120 to place the spool body (containing the electronic module) at the inlet of the drill hole. The choice depends for example on the dimensions of the hole, of the finned cap 30 and/or of the fin collar 120.

According to a second example, if the spool keeps a remainder of the cable wound, it could then be more interesting to first lock the stake on the finned cap 30 and then lock this new set on the cap 20 supporting the electronic module (as illustrated in FIG. 12) in order to place the resulting assembly at the inlet of the drill hole (the outlet of the electronic module 50 of the spool body 11 remaining optional, depending on the remainder of the cable still wound).

The diameters of the fin collar 120 of the spool body and of the finned cap 30 being different, the use of either one also allows adapting to different drill hole diameters.

This may be reinforced by the fact that the fins, of the finned cap 30 or of the fin collar 120, have a relative structural flexibility, which facilitates adaptation of the finned cap 30 or the fin collar 120 in the drill hole as the case may be.

The described functions integrated into the spool body allow limiting the modifications to be made to a detonator spool.

All these functions are also compatible with the insertion of the primer into the spool body, which is then protected and secured, in particular during transport.

It is then possible to avoid using an external tool to unwind the spool and install the detonator, since the stake (the unwinding tool) could be integrated into the spool.

The invention claimed is:

1. A detonator spool comprising:

at least one body configured to receive a cable wound around the at least one body;

an electronic control module housing configured to receive an electronic control module;

a bore forming a hub configured to make the at least one body of the detonator spool rotate, the bore being configured to receive a primer;

a stake configured to form a pivot connection with the bore forming the hub; and a stake housing configured to receive the stake.

2. The detonator spool according to claim 1, further comprising a cap configured to be fastened to a first end of the at least one body of the detonator spool, the cap including an inner face and an outer face, opposite to the inner face, the inner face including a fastening system configured to fasten the cap to the first end of the at least one body of the detonator spool, and wherein the detonator spool includes a fin collar which surrounds the first end of the at least one body.

3. The detonator spool according to claim 2, wherein the inner face of the cap includes a fastening system configured to fasten the electronic control module to the cap.

4. The detonator spool according to claim 2, wherein the cap includes a first fastening system configured to fasten the stake, the first to the cap at a first location extending from the inner face of the cap.

5. The detonator spool according to claim 4, wherein the cap includes a second fastening system configured to fasten the stake to the cap at a second location extending from the outer face of the cap.

6. The detonator spool according to claim 1, further comprising a finned cap including a central portion and a fin collar surrounding the central portion, and wherein the finned cap is configured to be fastened to a second end of the at least one body of the detonator spool.

7. An electronic detonator comprising:

an electronic control module;

a primer;

a connection cable connecting the primer and the electronic control module;

the detonator spool according to claim 1, wherein the stake includes a portion configured to cooperate with the bore to form the pivot connection, and at least one stop configured to limit an insertion of the stake into the bore.

8. The electronic detonator according to claim 7, further comprising a storage configuration in which the electronic control module is housed in the electronic control module housing, the primer is housed in the bore, and the connection cable between the electronic control module and the primer is wound around the at least one body of the detonator spool.

9. The electronic detonator according to claim 8, wherein, in the storage configuration, the cap is fastened to a first end of the at least one body of the detonator spool, and the electronic control module and the stake are fastened to the inner face of the cap, and the stake is accommodated, in the stake housing, in the at least one body of the detonator spool.

10. The electronic detonator according to claim 7, further comprising an installation configuration in which a portion of the stake is inserted into the bore forming a hub of the detonator spool, thereby forming a pivot connection configured to make the at least one body of the detonator spool rotate about the stake.

11. The electronic detonator according to claim 7, further comprising a use configuration in which the stake is fastened to the outer face of the cap.

12. The electronic detonator according to claim 11, wherein the stake includes an electrical connector and the electronic control module includes a connection interface, and wherein, in the use configuration, the electrical connector is electrically connected with the connection interface allowing electrically connecting an energy portion to a functional portion of the electronic control module.

13. A detonator spool comprising:

at least one body configured to receive a cable wound around the at least one body;

an electronic control module housing configured to receive an electronic control module;

a bore forming a hub configured to make the at least one body of the detonator spool rotate, the bore being configured to house a primer; and a cap configured to be fastened to a first end of the at least one body of the detonator spool, the cap including an inner face and an outer face, opposite to the inner face, the inner face including a fastening system configured to fasten the cap to the first end of the at least one body of the detonator spool.

* * * * *